US006542439B1

(12) United States Patent
Satodate et al.

(10) Patent No.: US 6,542,439 B1
(45) Date of Patent: Apr. 1, 2003

(54) ELECTRONIC TIMEPIECE HAVING INDICATION HANDS

(75) Inventors: Takayuki Satodate, Chiba (JP); Yuichi Shino, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/937,092

(22) PCT Filed: Jan. 24, 2000

(86) PCT No.: PCT/JP00/00326

§ 371 (c)(1),
(2), (4) Date: Jan. 29, 2002

(87) PCT Pub. No.: WO01/55800

PCT Pub. Date: Aug. 2, 2001

(51) Int. Cl.[7] ..... G04B 19/94; G04B 25/00
(52) U.S. Cl. ..... 368/80; 368/223
(58) Field of Search ..... 368/72–74, 76, 368/80, 223, 228, 238

(56) References Cited

U.S. PATENT DOCUMENTS 5,202,858 A * 4/1993 Kanzaki ..... 368/71
5,889,736 A * 3/1999 Fujita et al. ..... 368/66

FOREIGN PATENT DOCUMENTS

GB 8326155 * 11/1983
JP 57-153294 * 9/1982
JP 60-27389 * 2/1985
JP 4-315987 * 11/1992
JP 4-366788 * 12/1992
JP 9-297185 * 11/1997

* cited by examiner

*Primary Examiner*—Vit Miska
(74) *Attorney, Agent, or Firm*—Adams & Wilks

(57) ABSTRACT

An electronic timepiece with indicator hands having indicator hands capable of providing a variety of indications and capable of preventing unstable movement of the indicator hands, which comprises time hands (101, 102) for showing a time, first and second indicator hands (103, 104) provided separately from said time hands (101, 102), rotating means for reciprocally rotating said first and second indicator hands (103, 104) in directions opposite to each other within a predetermined range, and restricting means for restricting a movable range and capable of adjusting a restricting position of said first and second indicator hands (103, 104). Jumping of hands or the like of the first and second indicator hands (103, 104) due to impact or the like is restricted by the restricting means. Further, where there is a fear that the first and second indicator hands (103, 104) stop in a non-rotatable range, the restricting means is adjusted to change the movable range of the first and second indicator hand (103, 104).

4 Claims, 11 Drawing Sheets

ELECTRONIC TIMEPIECE HAVING INDICATION HANDS

TECHNICAL FIELD

The present invention relates to an electronic timepiece with indicator hands integrally formed with figures or the like.

BACKGROUND OF THE INVENTION

Conventionally, electronic timepieces with indicator hands integrally formed with figures, such as characters, have been utilized.

In the conventional electronic timepiece with indicator hands, the hand functioning as an indicator hand is structured by a needle-shaped second hand or disk-formed second hand wherein the second hand serves also as the indicator hand. Meanwhile, also in the conventional timepiece having an indicator hand moved only by user's operation, the indicator hand has been used also as a time hand to show time. Alternatively, the indicator hand has been moved by interlocking with the time hand.

Consequently, in any of the electronic timepieces, there is nothing more than having one indicator hand serving also to show a time. With one indicator hand only, it is impossible to provide a variety of motions to the figure, such as a character, and thus it has been impossible to give a variety of indications.

Meanwhile, although there have existed the timepieces having indicator hands moving at all times, these are nothing more than merely having a figure or the like on a disk-formed second hand or needle-like second hand. Thus, a variety of indications, e.g. providing a variety of motions, have been impossible to perform.

Also, where the indicator hand serves also as a time hand or is moved by interlocking with the time hand, the figure or the like integrally formable on the indicator hand is restricted in size by the restriction due to moment of the hand. Thus, it has been impossible to use an indicator hand capable of providing a variety of indications.

It can be considered as a method of solving this problem and realizing a variety of indications by the indicator hand to provide a plurality of indicator hands separately from the time hands and providing a motor to rotatively drive the indicator hands so that the indicator hands are structured to reciprocally move by and rotating the motor forward and reverse by a constant amount. However, if the indicator hands is merely reciprocally moved, there is a fear that the indicator hand jumps due to impact or the like resulting in instability of indicative motion.

As a method for solving this problem, it is an effective method to provide such a mechanism as restricting the rotation range of the indicator hands within a predetermined range.

In this case, the restriction range is preferably given variable in respect of providing more various indications.

Also, in the case of providing a mechanism for merely restricting the indicator-hand rotation range to a predetermined range, where the motor uses a stepping motor for timepieces as generally used in the timepieces, there is a problem that the stepping motor, when stopped in a particular region, becomes inoperative of subsequent rotational movement.

That is, the stepping motor for timepieces is rotated forward by supplying a forward driving pulse alternately to a pair of terminals on the motor coil, as described in Japanese Patent Laid-open No. 127365/1979. In reverse rotation, a forward driving pulse is first supplied to once cause slight rotation and then a reverse driving pulse is supplied to cause reverse rotation. In this manner, because there exists a region where rotation is impossible to occur without giving impetus for reverse rotation, forward rotation is first made to provide impetus and then causing reverse rotation. However, as shown of a typical view of the stepping motor in FIG. 11, if the rotor magnet is stopped at a particular region, impetus cannot be given to the rotor magnet 1101, thus possibly resulting in a case of impossibility of subsequent rotation. Hereunder, described in detail is the operation where the rotor magnet 1101 is brought into inoperative.

In FIG. 11, 1101 is a rotor magnet having N and S poles, 1102 is a stator, 1103 is a convex part attached on the rotor magnet 1101, and 1104 is a convex part attached on a fixing part. A forward driving pulse and a reverse driving pulse are supplied to a coil (not shown) to thereby applying a magnetic field for rotating the rotor magnet 1101 forward and reverse.

In the meanwhile, it is assumed that a magnetic field is being applied in an X-axis direction in FIG. 11(*a*). If forward rotation is given in a direction of the arrow and the convex part 1103 and the convex part 1104 become engagement to stop the rotor magnet 1101 in an illustrated position, it is impossible to give impetus for reverse rotation. Thus, reverse rotation is impossible to cause. Meanwhile, also in FIG. 11(*b*), reverse rotation is similarly impossible to cause. That is, although when the motor stops in the second quadrant and fourth quadrant reverse rotation can be made, in the first quadrant and third quadrant there is a non-rotation region where the motor cannot be rotated reverse.

Consequently, by merely providing such a mechanism as restricting the indicator-hand rotation range to a predetermined range, the motor will stop in the non-rotatable region. This results in a fear that the indicator hands cannot be rotatively driven and the operation of the indicator hands becomes unstable.

It is an object of the present invention to provide an electronic timepiece with indicator hands which is capable of offering a variety of indications and preventing the indicator hands from moving unstably.

DISCLOSURE OF THE INVENTION

The present invention utilizes the technological structure as described below in order to achieve the above object.

That is, an electronic timepiece with indicator hands, according to the present invention is characterized by comprising: time hands for showing a time; a first and second indicator hands provided separately from the time hands; rotating means for reciprocally rotating the first and second indicator hands in directions opposite to each other within a predetermined range; and restricting means for restricting a movable range and capable of adjusting a restricting position of the first and second indicator hands.

The rotating means reciprocally rotates the first and second indicator hands in directions opposite to each other. Where the first and second hands are rotating toward the outside of a range restricted by the restricting means due to impact or the like, the restricting means restricts rotation of the first and second indicator hands. Also, where a variety of indications are desired by changing the restriction range of the first and second indicator hands or there is a fear that the first and second indicator hands stop in a non-rotatable region, the restricting means is adjusted to change the movable range of the first and second indicator hands. This makes it possible to provide indicator hands for a variety of indications and an electronic timepiece with indicator hands capable of preventing unstable operation of the indicator hands.

Here, the rotating means may be structured to rotate the first and second indicator hands at the same speed.

Also, the rotating means may be structured to have a stepping motor for timepieces to alternately cause forward rotation and reverse rotation by a predetermined amount, a train wheel for delivering rotation of the stepping motor to the first and second indicator hands.

Furthermore, the restricting means may comprise a first engaging means having a convex part rotatably attached with eccentricity and a second engaging part provided on a wheel included in the train wheel, so that, when the indicator hands are rotating toward the outside of a restricted movable range, the first engaging part and the second engaging part engage to thereby restrict rotation of the first and second indicator hands.

Incidentally, the electronic timepiece may be an electronic wristwatch.

BEST MODE FOR CARRYING OUT THE INVENTION

Hereunder, concrete examples of electronic timepieces with indicator hands according to the present invention will be explained in detail with reference to the drawings.

Figure 1:
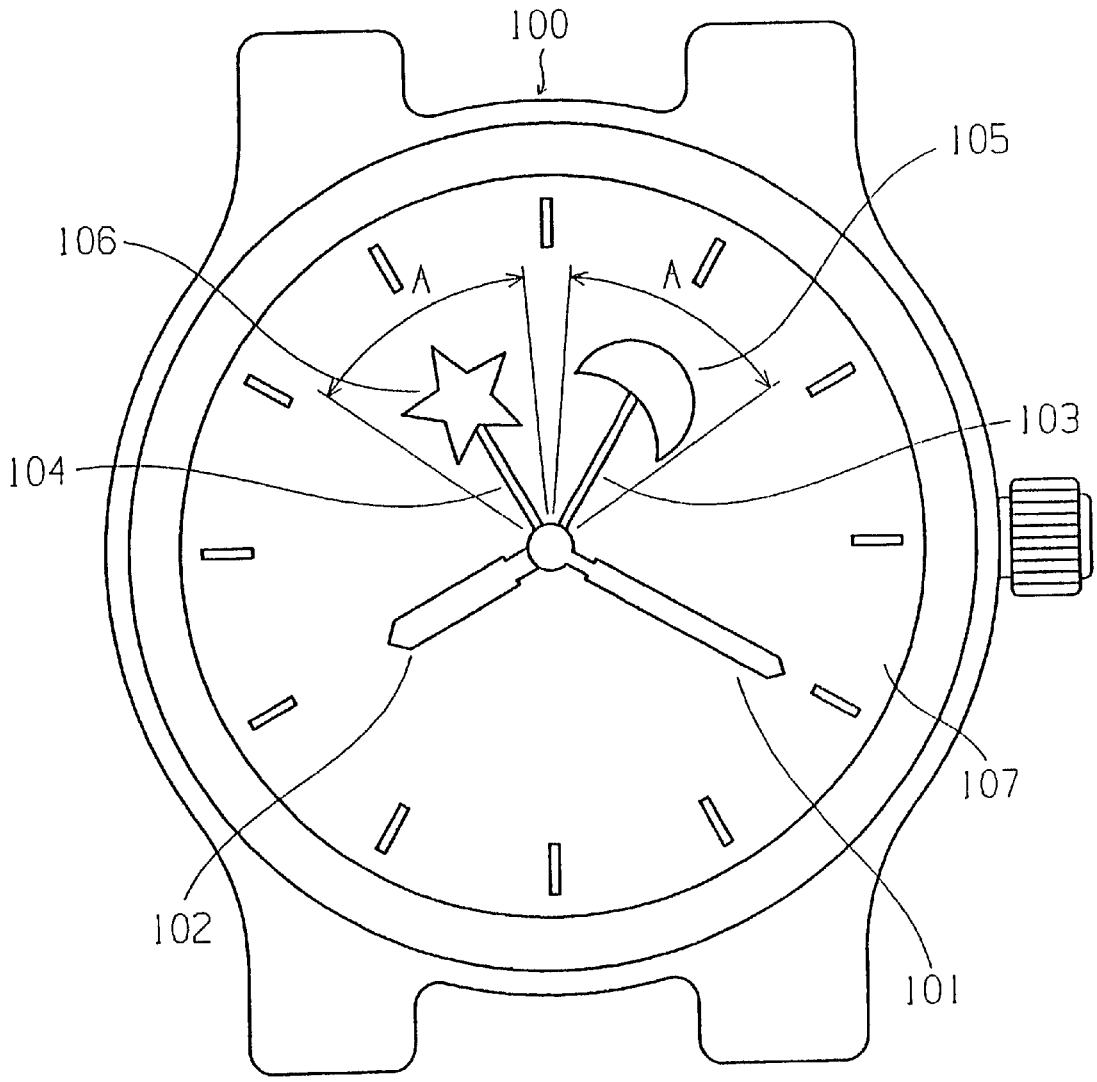
FIG. 1 is a front view showing an outside view of a concrete example of an electronic timepiece with indicator hands according to the present invention.

FIG. 1 is a front view showing an external view of a concrete example of an electronic timepiece with indicator hands according to the invention, showing an example of electronic wristwatch. In FIG. 1, an electronic wristwatch with indicator hands 100 has time hands of a minute hand 101 and an hour hand 102 to represent a time and provided with a first indicator hand 103 formed integral with a crescent-shaped FIG. 105 and a second indicator hand 104 formed integral with a star-shaped FIG. 106. The indicator hands 103, 104 are arranged between the minute hand 101 and hour hand 102 and the dial 107.

As described hereafter, by using two train wheels having as a drive source a motor different from a motor for driving the time hands 101, 102 to have a reduction ratio corresponding to a second hand and transmitting rotation opposite in direction with respect to the indicator hands 103, 104, a pair of indicator hands 103, 104 are each driven and rotated such that they respectively reciprocate in opposite direction at the same speed and in a same predetermined angle A.

Figure 2:
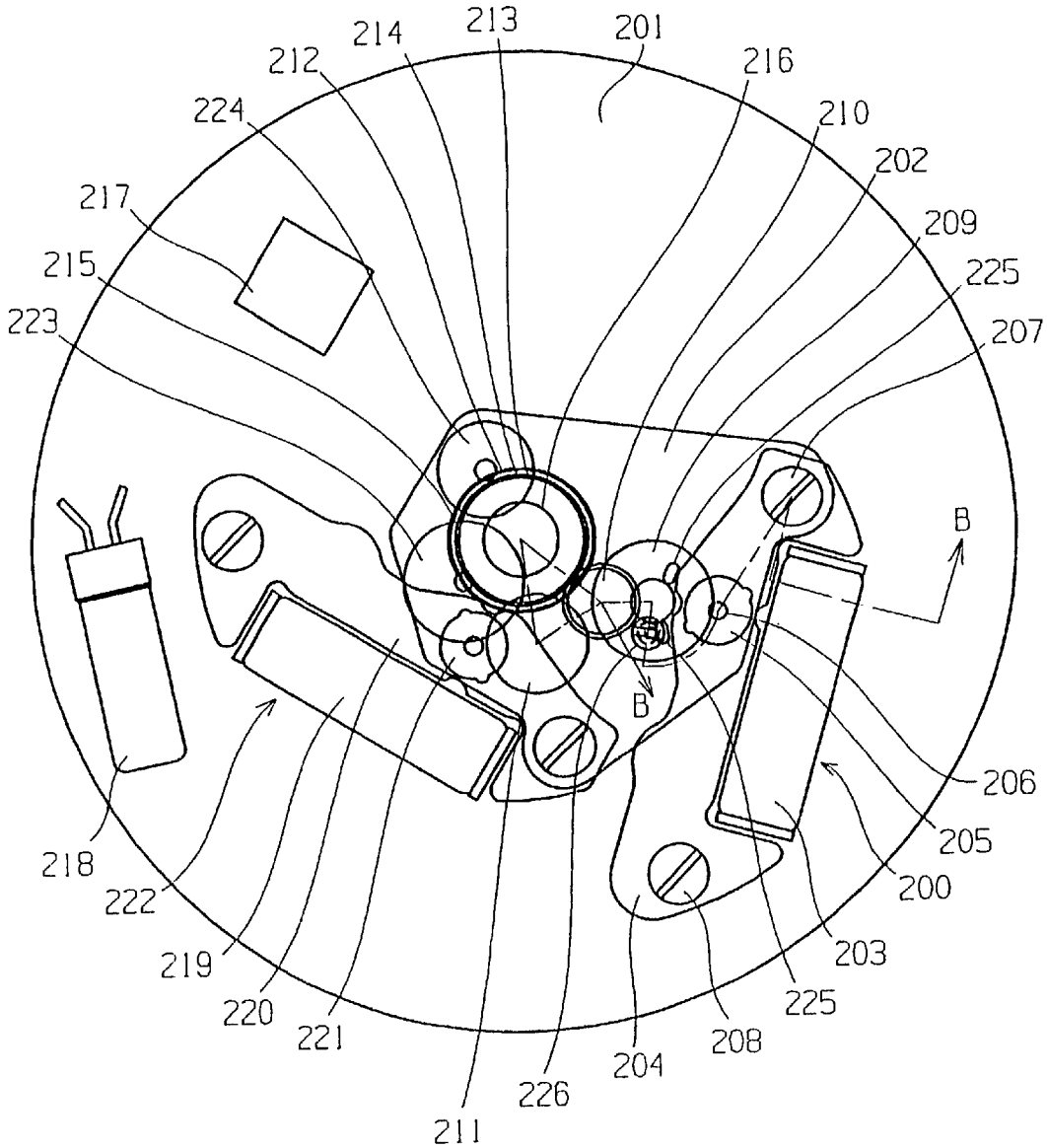
FIG. 2 is a rear view of a driver mechanism to be used in the concrete example of the electronic timepiece with indicator hands according to the invention.
Figure 3:
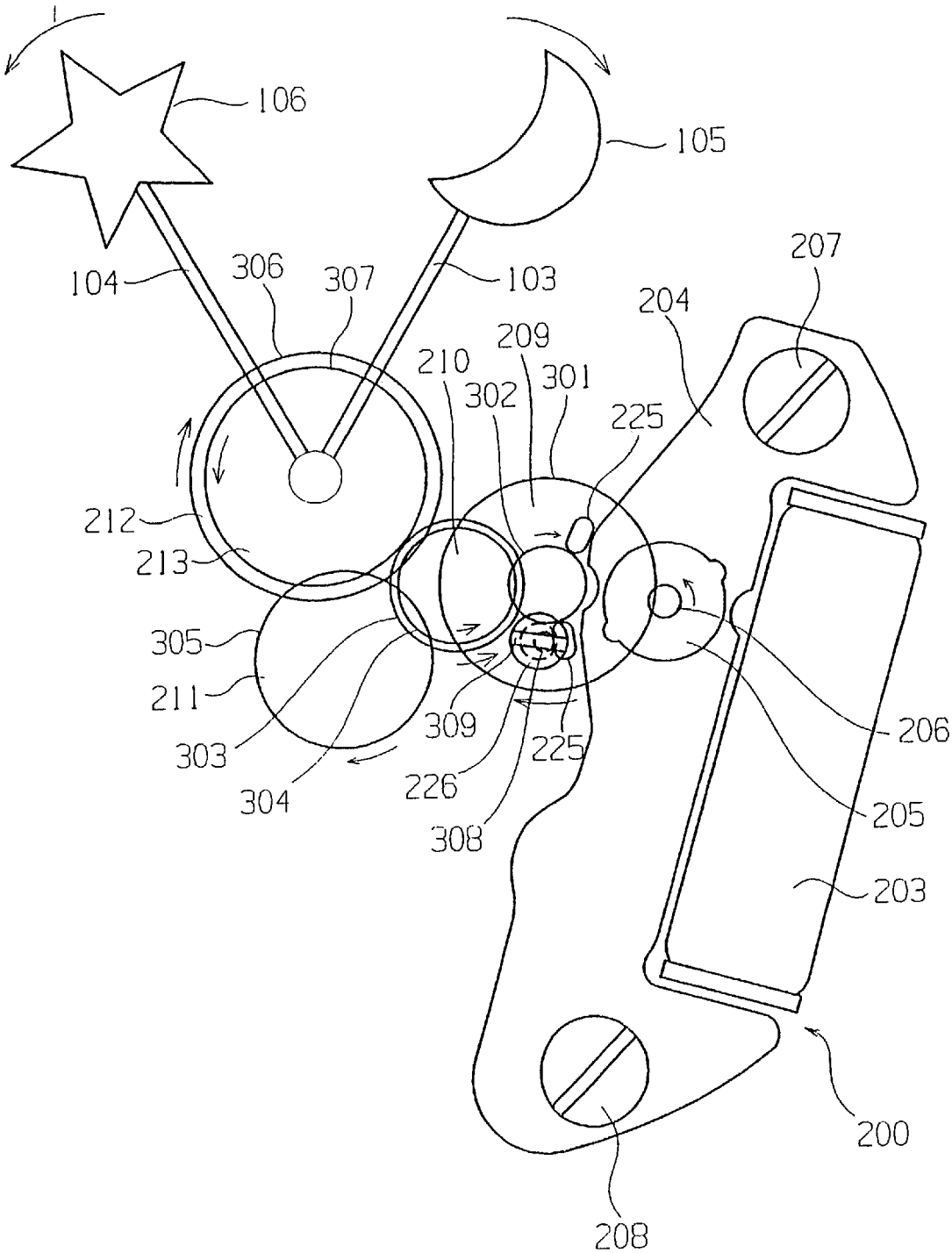
FIG. 3 is an enlarged rear view of a driver mechanism to be used in the concrete example of the electronic timepiece with indicator hands according to the invention.
Figure 4:
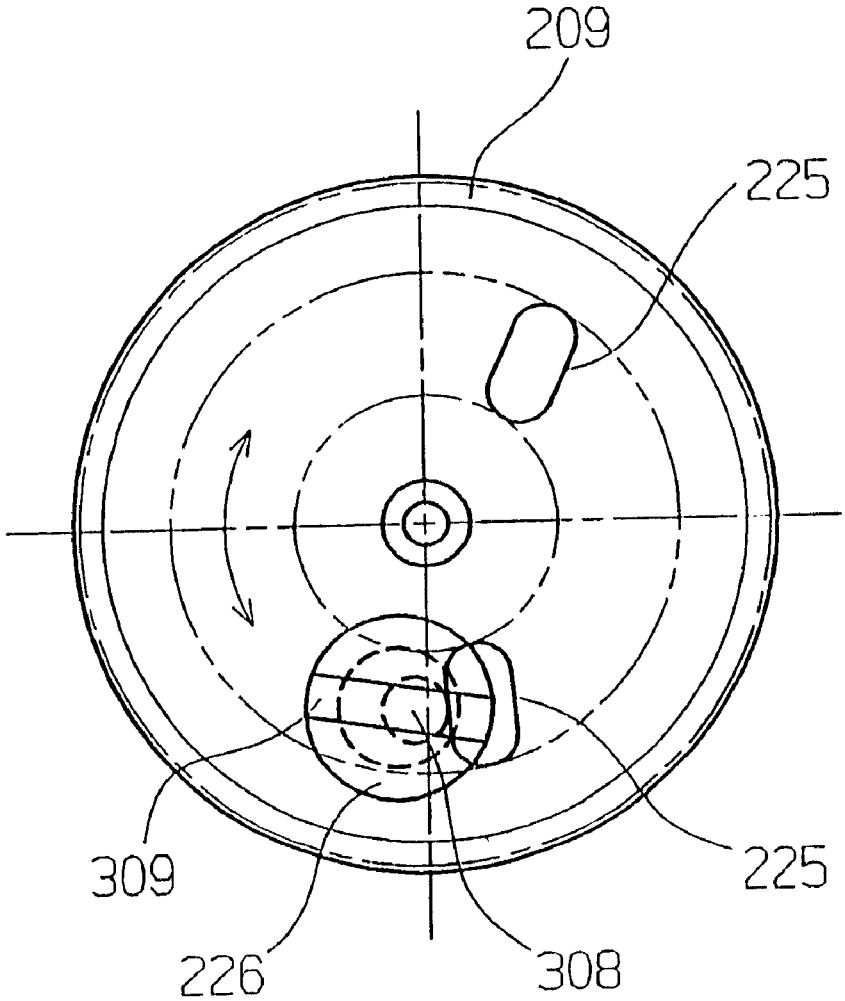
FIG. 4 is a partially enlarged view of FIG. 3.
Figure 5:
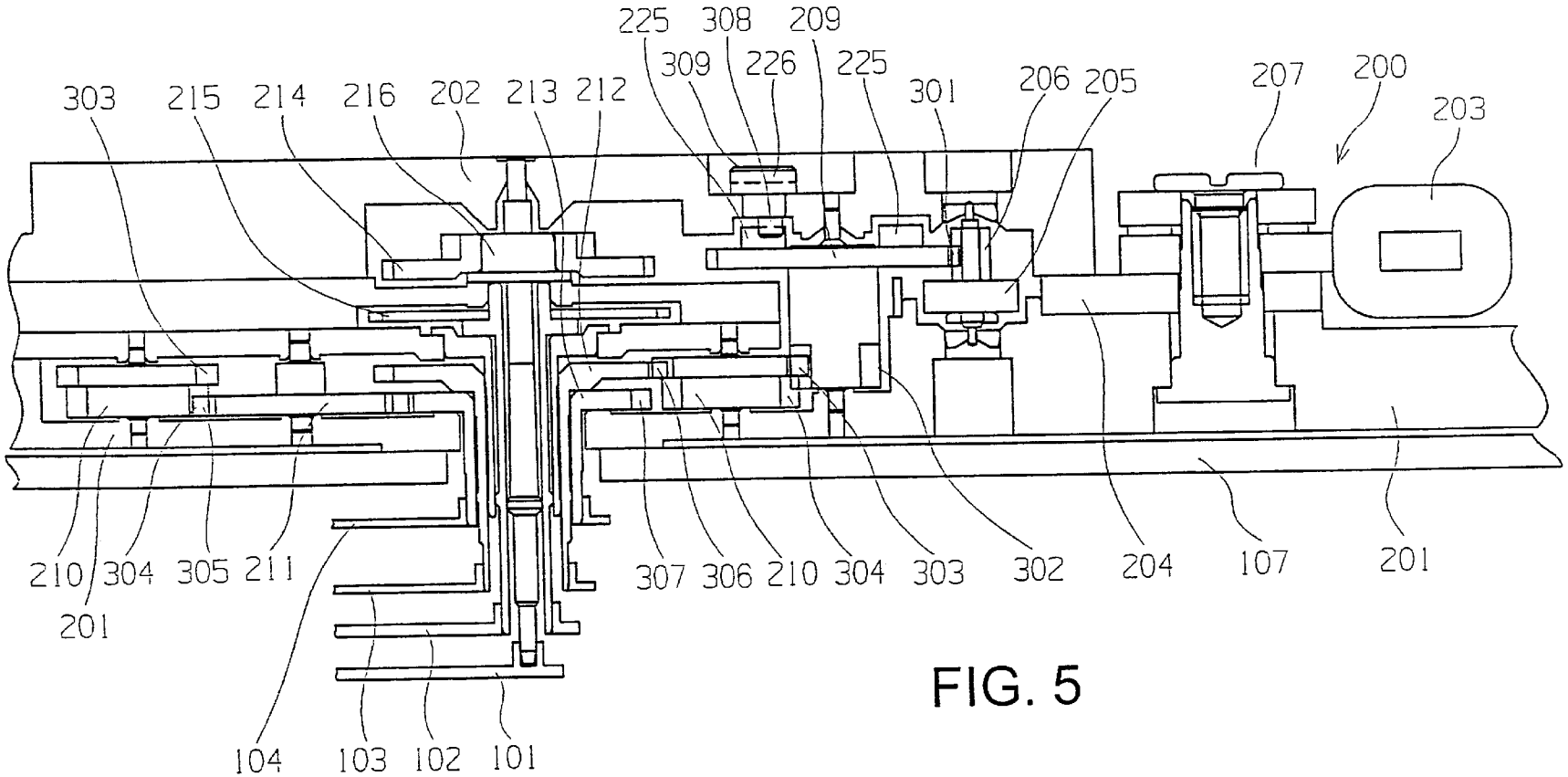
FIG. 5 is a B—B sectional view in FIG. 2.
Figure 6:
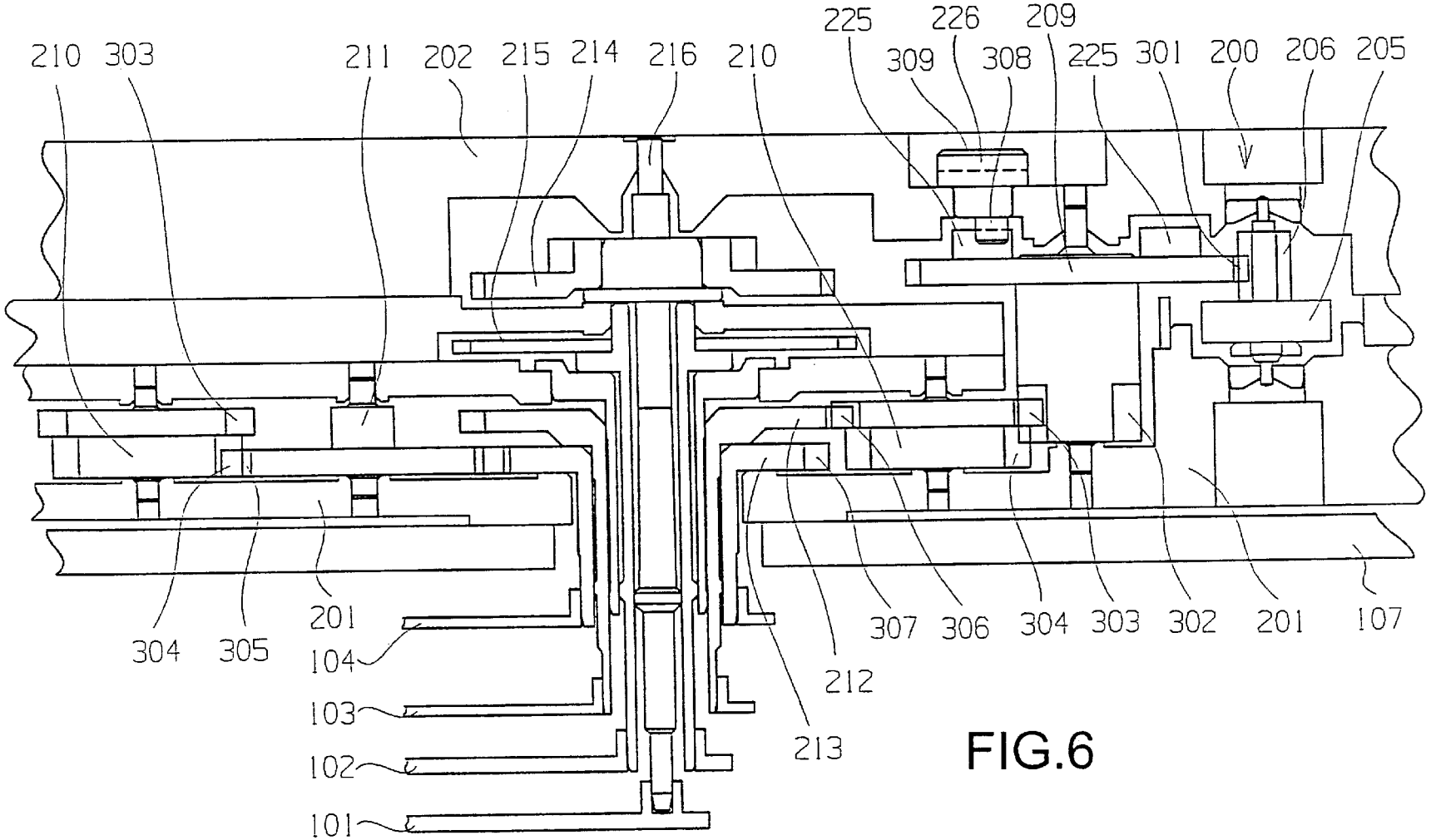
FIG. 6 is a partially enlarged sectional view of FIG. 5.

FIG. 2 is a rear view showing a driving mechanism of the electronic wristwatch with indicator hands 100 shown in FIG. 1. FIG. 3 is an enlarged rear view showing the driving mechanism of the electronic timepiece with indicator hands shown in FIG. 1. FIG. 4 is a partially enlarged view of FIG. 3. FIG. 5 is a B—B sectional view in FIG. 2. FIG. 6 is a partially enlarged sectional view of FIG. 5. In the figures, the identical parts are given identical reference numerals.

In FIG. 2 to FIG. 6, between a main plate 201 and a support plate 202, there are accommodated the time hands of the minute hand 101 and the hour hand 102, a driving mechanism to rotatively drive the pair of indicator hands 103, 104 and an electronic circuit. Concretely, they are structured as described below in detail.

A first stepping motor 200 comprising a coil 203, a stator 204 and a rotor magnet 205 is a well-known stepping motor for a timepiece (see, for example, the Japanese Patent Laid-open publication stated before). As described later, this provides forward rotation drive and reverse rotation drive so as to reciprocally rotate the indicator hands 103, 104 in directions opposite to each other within a predetermined range (in an angular range A in FIG. 1). The stator 204 and coil 203 are fixed on the main plate 201 with screws 207, 208.

The rotor magnet 205 has a gear 206 which is in mesh with a gear 301 of a wheel 209. The wheel 209 has a pinion 302 which is in mesh with a gear 303 of a wheel 210. Also, the gear 303 of the wheel 210 is in mesh with a gear 306 of an hour wheel 212 to rotatively drive the indicator hand 103.

On the other hand, a pinion 304 of the wheel 210 is in mesh with a gear 305 of a wheel 211 for reverse rotation. Also, the gear 305 of the wheel 211 is in mesh with a gear 307 of the hour wheel 213 to rotatively drive the indicator hand 104.

The support plate 202 is attached with a restricting member 226 constituting a first engaging part. The restricting part 226 is opposed to the wheel 209 and has an eccentric pin 308 as a convex part integrally formed in a position deviated from a center thereof. On a back side of the eccentric pin 308, a groove 309 is formed for allow rotation by a screwdriver. Incidentally, to rotate the restricting member 226 requires a constant rotational force. This is structured not to rotate due to a rotational force given upon engaging the convex part 225 of the wheel 209, as described below.

This provides a structure that a position of an eccentric pin 309, i.e. restricting position, can be changed by rotating the restricting member 226 with the screwdriver engaged in the groove 309.

The wheel 209 is integrally formed with two convex parts 225 constituting a second engaging part. Here, the restricting member 226 and the both convex parts 225 constitute restricting means.

If the wheel 209 rotates in one direction, one convex part 225 engages the eccentric pin 309 to restrict the wheel 209 from rotating in one direction. Also, if the wheel 209 rotates in the other direction, the other convex part 225 engages the eccentric pin 309 to restrict the wheel 209 from rotating in the other direction.

Due to this, the wheel 209 is restricted in rotational range. Consequently, when the indicator hands 103, 104 are going to rotate toward the outside of a predetermined restriction range (e.g. an angular range A in FIG. 1), the eccentric pin 308 of the restricting member 226 and both convex parts 225 of the wheel 209 come into engagement, thereby restricting the rotation of the indicator hand 103, 104 within the predetermined range.

Meanwhile, the wheels 209, 210 and the hour wheel 212 constitute a first train wheel to deliver rotation reverse to a rotational direction of the stepping motor 200 (i.e. rotational direction of the rotor magnet 205) to the first indicator hand 103. The wheels 209, 210, 211 and the hour wheel 213 constitute a second train wheel which delivers rotation in the same direction as a rotational direction of the stepping motor 200 to the second indicator hand 104. Here, formed the same are the gear ratio of the first train wheel of from the pinion 302 of the wheel 209 to the gear 306 of the hour wheel 212 and the gear ratio of the second train wheel of from the pinion 302 of the wheel 209 to the gear 307 of the hour wheel 213. The indicator hand 103 and the indicator hand 104 are structured such that they are driven and rotated at the same speed in directions opposite to each other. This rotatively drives the crescent-shaped FIG. 105 integrally formed on the indicator hand 103 and the star-shaped FIG. 106 integrally formed on the indicator hand 104 at the same speed in directions opposite to each other.

Incidentally, the stepping motor 200, the wheels 209, 210, 211, the hour wheels 212, 213 constitute rotation means for reciprocally rotating the first and second indicator hands 103, 104 oppositely in a predetermined range.

On the other hand, the electronic wristwatch 100 has drive means for rotatively driving the time hands of the minute hand 101 and the hour hand 102. That is, it is provided with a second stepping motor 222 structured by a coil 219, a stator 220 and a rotor magnet 221. Further, it is provided with a third train wheel structured by a wheel 214 for rotatively driving wheels 223, 224 for delivering rotation of the rotor magnet 221, a wheel 214 for rotatively driving the minute hand 101 and an hour wheel 215 for rotatively driving the hour hand 102.

The hour wheel 212, 213, 215 are concentrically arranged on a shaft 216 formed integral with a wheel 214. Due to this, the minute hand 101, the hour hand 102 and the indicator hands 103, 104 are arranged on the same shaft.

Also, an electronic circuit is incorporated which comprises an integrated circuit 217 incorporating therein a quartz oscillator 218 and driver circuit constituting an oscillator circuit.

Figure 7:
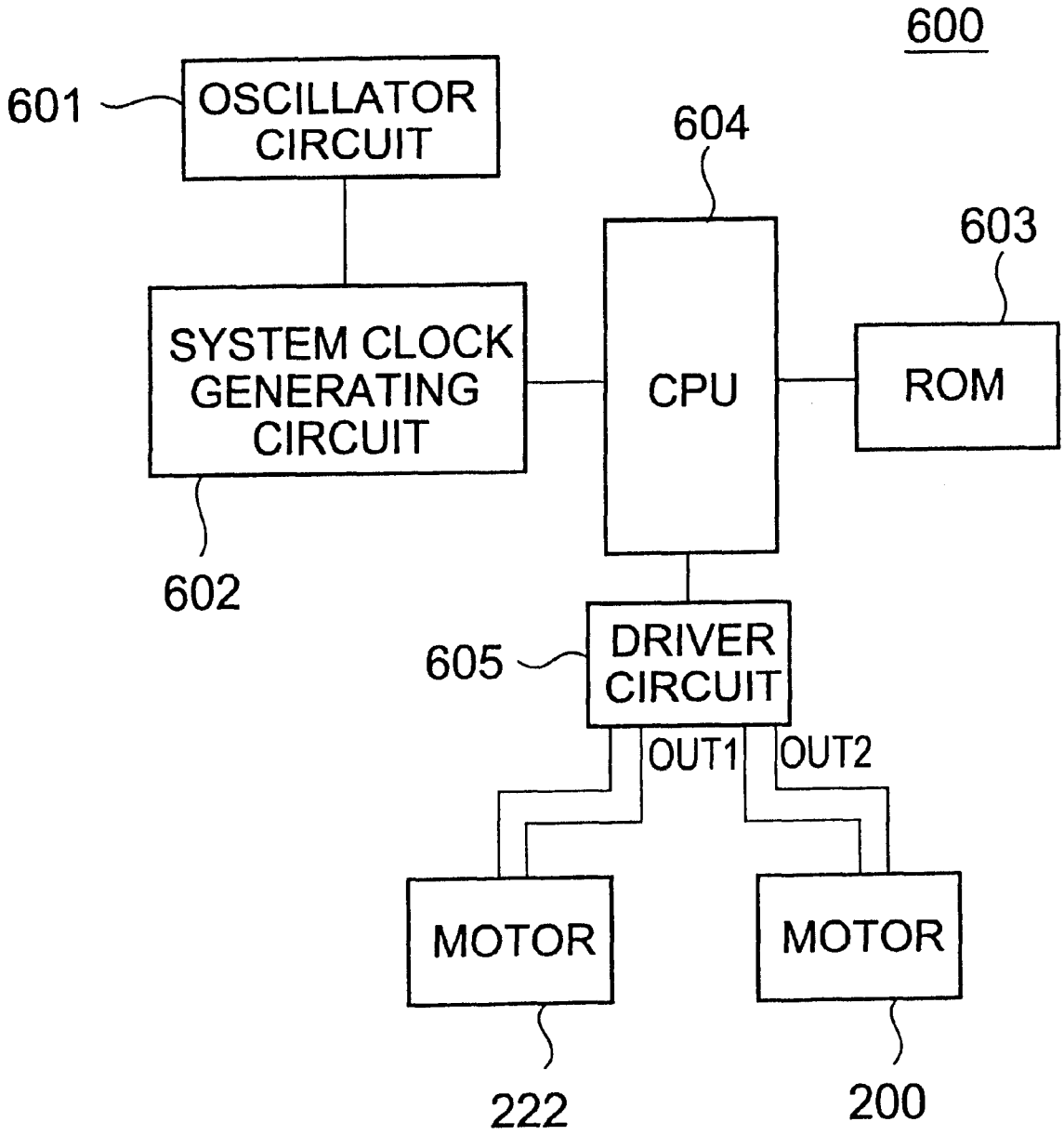
FIG. 7 is a block diagram of a driver circuit to be used in the concrete example of the electronic timepiece with indicator hands according to the invention.

FIG. 7 is a block diagram of a driver circuit 600 used in one embodiment of an electronic timepiece with indicator according to the invention. In FIG. 7, the driver circuit 600 has an oscillator circuit 601 structured by a quartz oscillator 218 or the like, a system clock generating circuit 602 for generating a system clock from an output signal of the oscillator circuit 601, a non-volatile read only memory (ROM) 603 storing programs and motor driving pulses described hereafter, and constituting storage means, a central processor unit (CPU) 604 which is to be operated by a program stored in the ROM 603 in response to a system clock from the system clock generating circuit 602 and performs various operations and drive-controls the stepping motor 200, 222, a driver circuit 605 for supplying a drive signal to the stepping motor 200, 222, a stepping motor 200 for rotatively driving the indicator hands 103, 104, and a stepping motor 222 for rotatively driving the minute hand 101 and the hour hand 102.

Figure 8:
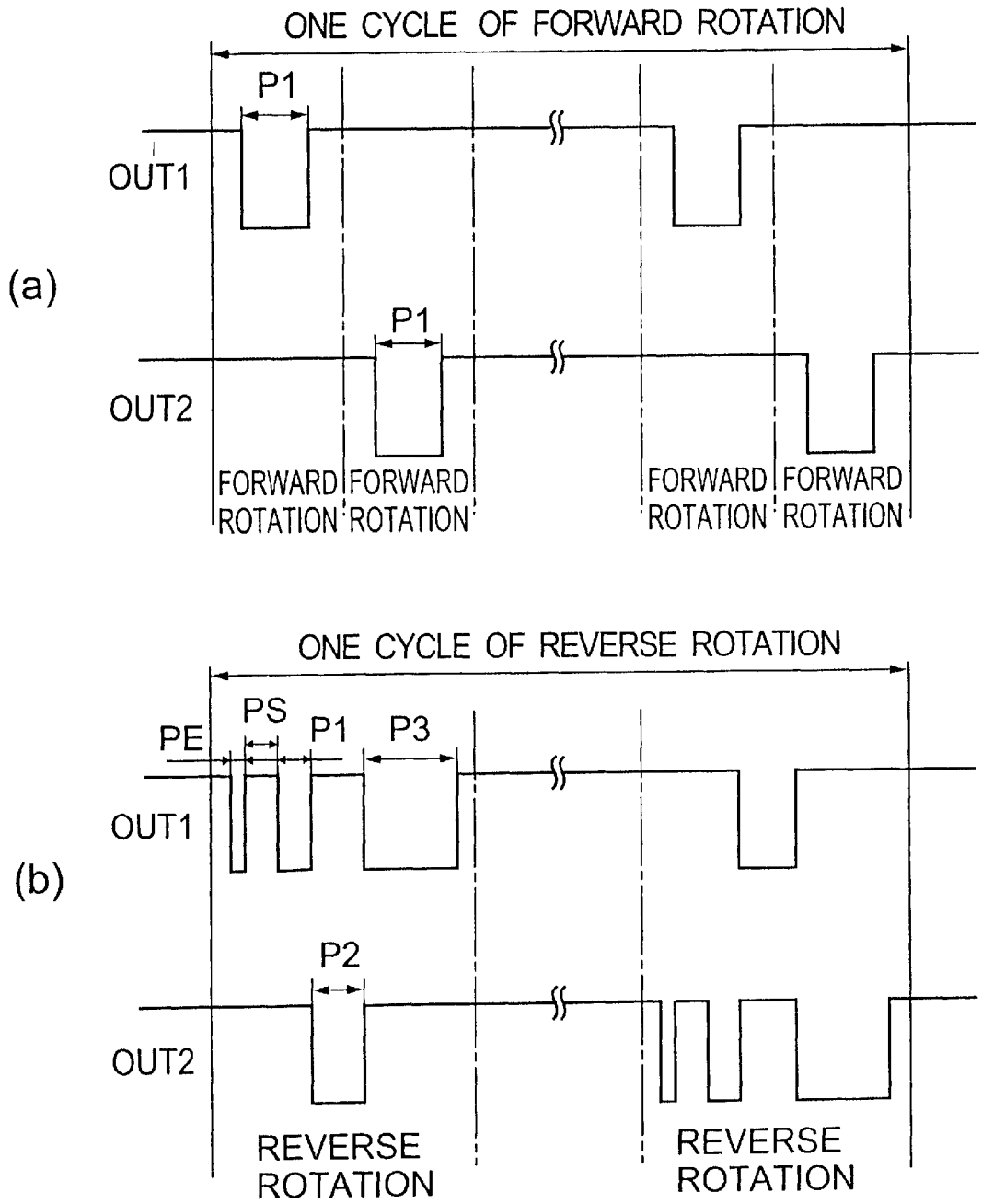
FIGS. 8(*a*) and 8(*b*) are timing views for explaining the operation of the driver circuit shown in FIG. 7.

The ROM stores a drive pulse waveform shown in FIG. 8. Where the stepping motor 200 is driven forward or reverse, the CPU 604 reads the drive pulse out of the ROM 603 and drive the stepping motor 200 forward and reverse through the driver circuit 605 (see, for example, the aforesaid Japanese Patent Laid-open publication).

That is, in FIG. 8, where the stepping motor 200 is rotated forward, it is rotated forward by applying a pulse with a time width P1 to a terminal OUT1 as shown in FIG. 8(*a*). Next, a pulse with a time width P1 is applied to a terminal OUT2 to cause forward rotation. This is alternately repeated by one period (e.g. 10 times of forward rotations) thereby repeating forward rotation of the stepping motor 200.

Also, where the stepping motor 200 is reversely rotated, first a demagnetizing pulse with a time width PE is supplied to the terminal OUT1 as shown in FIG. 8(*b*). After a lapse of a time PS, a pulse with a time width P1 is supplied to once cause forward rotation. Thereafter, a pulse with a time width P2 for reverse rotation is supplied to the terminal OUT2, and thereafter a pulse with a time width P3 for reverse rotation is supplied to the terminal OUT1. This causes the stepping motor 200 to rotate reverse. The above operation is made by one period (e.g. 10 times of reverse rotations).

Thereafter, forward rotation and reverse rotation as above, by one period each, are alternately made to cause the stepping motor 200 to rotate forward and reverse by the same predetermined amount. This is repeated.

This rotatively drives the rotor magnet 205 of the stepping motor 200 alternately in forward and reverse directions by the same amount.

For example, if the stepping motor 200 is rotated forward (in the arrowed direction in FIG. 3) by a predetermined number of times, the wheel 209, the wheel 210, and the hour wheel 212 rotate in respective arrowed directions. Due to this, the indicator hand 103 rotates by an angular rage A in the arrowed direction (clockwise). Simultaneously, the wheel 211 in mesh with the wheel 210 rotates in the arrowed direction to rotate the hour wheel 213 in the arrowed direction, rotating the indicator hand 104 by the angular range A in the arrowed direction (counterclockwise).

Next, when the stepping motor 200 rotates reverse (in a direction opposite to the arrow in FIG. 3) by the predetermined number of times, the wheel 209, the wheel 210 and the hour wheel 212 rotate in a direction opposite to the arrow. Due to this, the indicator hand 103 rotates by the angular range A. Simultaneously, the wheel 211 in mesh with the wheel 210 rotates in a direction opposite to the arrow. This causes the hour wheel 213 to rotate in a direction opposite to the arrow, rotating the indicator hand 104 by the angular range A in the direction opposite to the arrow (clockwise).

Thereafter, the above movement is repeated. Due to this, the crescent-shaped FIG. 105 integral with the indicator hand 103 and the star-shaped FIG. 106 integral with the indicator hand 104 reciprocally move in directions opposite to each other in the same angular range A. Incidentally, the range of rotation of the indicator hand 103, 104, i.e. the range of rotation angle A in FIG. 1 is determined by the amount (number) of forward and reverse rotation of the stepping motor 200. By setting a rotation amount of the stepping motor 200 in various ways, the rotational range of the indicator hand 103, 104 can be set variously. Accordingly, it is possible to reciprocally rotate the crescent FIG. 105 and the star FIG. 106 in a variety of ranges.

When the indicator hands 103, 104 reciprocally move normally within the angular range A in the above manner, in the event that the indicator hand 103, 104 jump due to mechanical impact or the like and moves toward the outside of the predetermined angular range A, the wheel 209 rotates due to rotation of the indicator hands 103, 104. Thereupon, one of the convex parts 225 integrally formed on the wheel 209 engages the eccentric pin 308 of the restricting member 226 to restrict the indicator hands 103, 104 from rotating furthermore. Also, where the indicator hands 103, 104 are going to rotate in the other direction toward the outside of the angular range A, the other convex part 225 engages the eccentric pin 308 to restrict the indicator hands 103, 104 from rotating furthermore in the other direction. This can prevents the indicator hands 103, 104 from moving abnormally.

Figure 11:
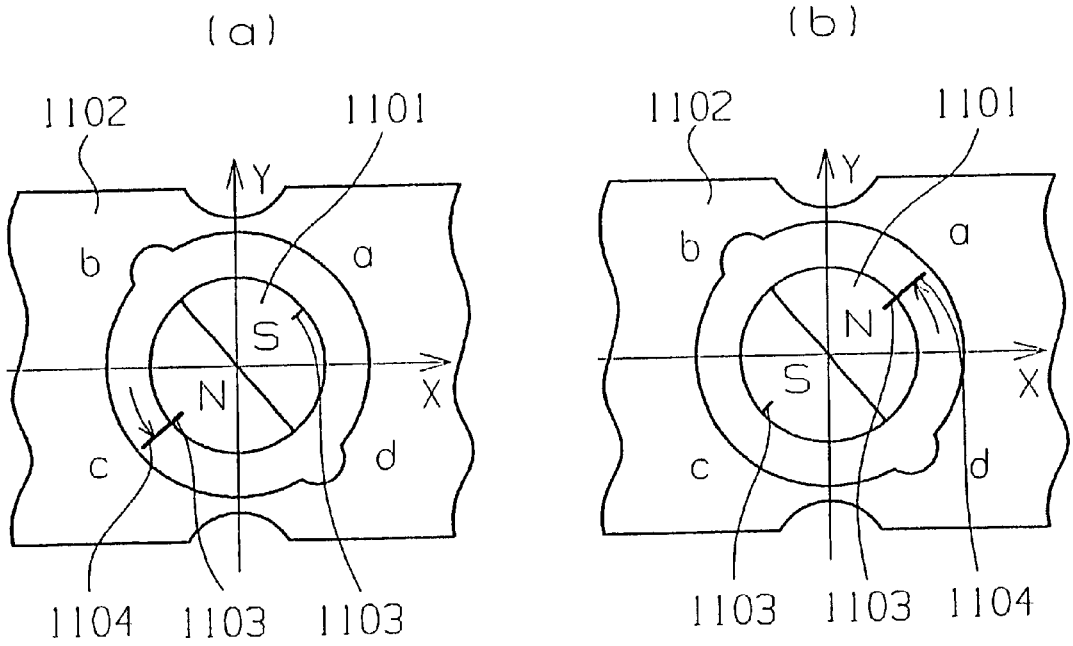
FIGS. 11(*a*) and 11(*b*) are typical views for explaining the operation of a stepping motor for timepieces to be used in the electronic timepiece with indicator hands according to the invention.

Also, as stated above, by previously adjusting the position of the eccentric pin 308 so as not to cause the rotor magnet 205 to stop in the non-rotatable region in FIG. 11 when the indicator hands 103, 104 stop rotating, it is possible to prevent an event that the rotor magnet 205 becomes non-rotatable by being stayed in the stop position. Accordingly, the rotor magnet 205 can be returned into forward and reverse rotational operation, and hence the indicator hands 103, 104 can return to normal operation.

Figure 9:
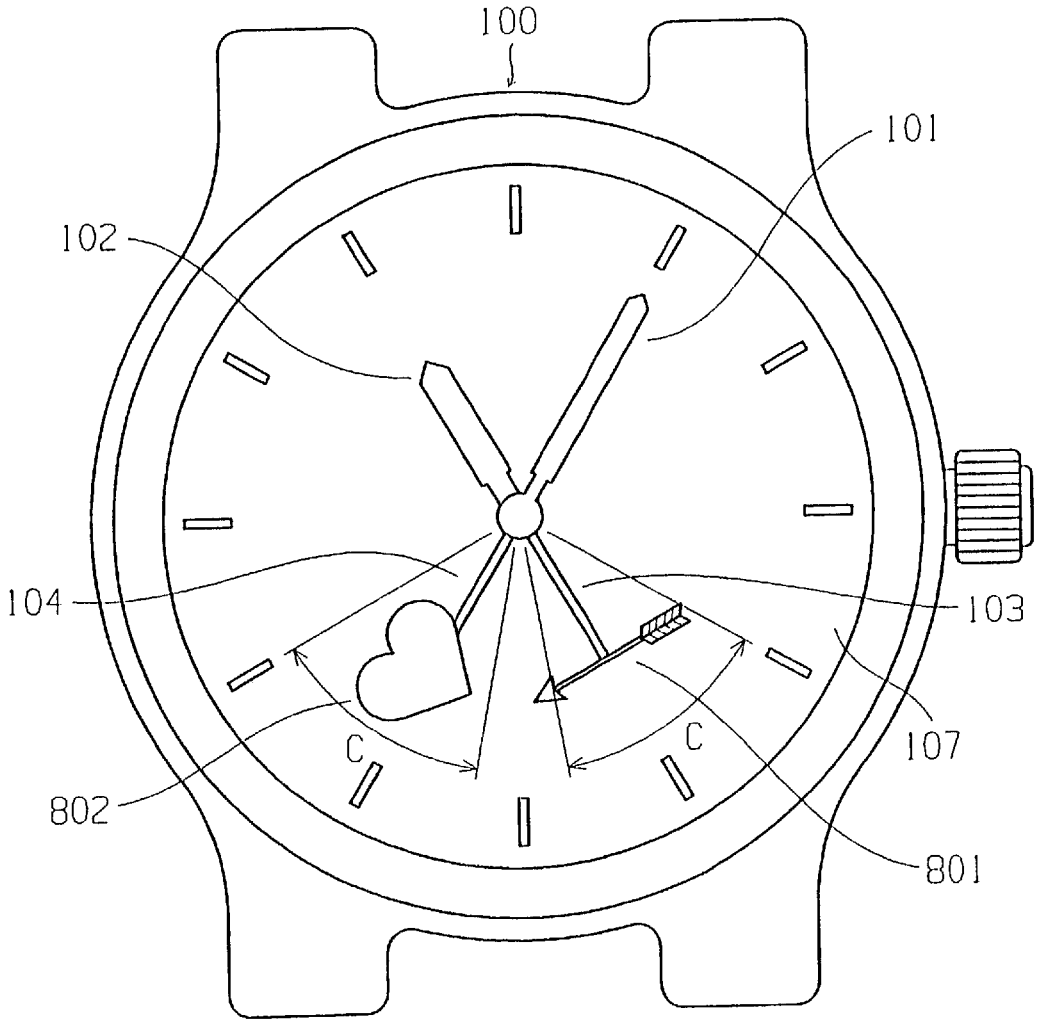
FIG. 9 is a front view showing an outside view of another concrete example of an electronic timepiece with indicator hands according to the present invention.

FIG. 9 is a front view showing an external view of another concrete example of an electronic timepiece with indicator hands according to the invention. The identical parts to FIG. 1 are given the identical reference numerals.

In FIG. 9, an electronic wristwatch with indicator hands 100 has time hands comprising a minute hand 101 and an hour hand 102 and provided with a first indicator hand 103 formed integral with an arrowed FIG. 801 and a second indicator hand 104 formed integral with a heart-shaped FIG. 802. The indicator hands 103, 104 are arranged between the minute hand 101 and hour hands 102 and the dial 107. A pair of indicator hands 103, 104 are each driven and rotated to reciprocally move at the same speed in directions opposite to each other within the same predetermined range of angle C.

Figure 10:
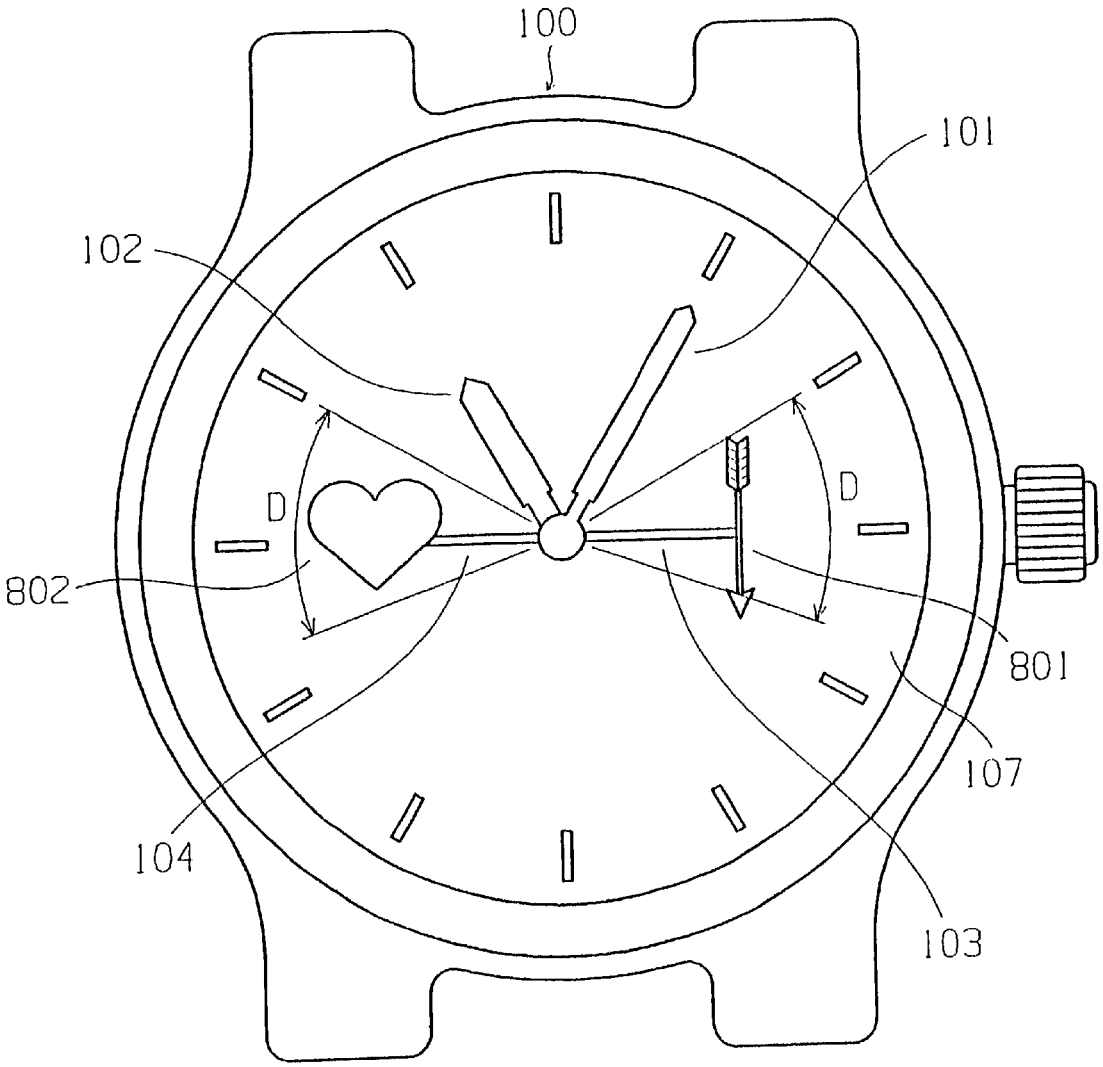
FIG. 10 is a front view showing an outside view of another concrete example of an electronic timepiece with indicator hands according to the present invention.

FIG. 10 is a front view showing an external view of another concrete example of an electronic wristwatch with indicator hands according to the invention. The identical parts to FIG. 1 and FIG. 9 are given the identical reference numerals.

In FIG. 10, an electronic wristwatch with indicator hands 100 has time hands comprising a minute hand 101 and an hour hand 102 and also is provided with a first indicator hand 103 formed integral with an arrowed FIG. 801 and a second indicator hand 104 formed integral with a heart-shaped FIG. 802. A pair of indicator hands 103, 104 are arranged between the minute hand 101 and hour hands 102 and the dial 107. The indicator hands 103, 104 in pair are each driven and rotated to reciprocally move at the same speed in directions opposite to each other within the same predetermined range of angle D.

As shown in FIG. 1, FIG. 9 and FIG. 10, a variety of representations can be provided by making the figures put on the indicator hands 103, 104 with various figures such as characters or letters, changing the attaching angle to the indicator hand 103, 104 or changing the range of rotational angle of the indicator hand 103, 104.

As described above, the electronic wristwatch with indicator hands 100 according to the concrete example of the invention is characterized by comprising, in particular, the time hands 101, 102 showing a time, the first and second indicator hands 103, 104 provided separately from the time hands 101, 102, rotating means (stepping motor 200, wheels 209, 210, 211, hour wheels 212, 213) for reciprocally rotating the first and second indicator hands 103, 104 in directions opposite to each other within a predetermined range, and restricting means for restricting the range in which the first and second indicator hands 103, 104 can move and capable of adjusting restricting position (convex parts 225, restricting member 226).

Accordingly, it is possible to provide an electronic wristwatch with indicator hands 100 which is capable of providing a variety of indications by the indicator hands 103, 104 and preventing the indicator hands 103, 104 from jumping due to impact or the like and unstably moving due to impossibility of motor rotation.

Also, it is possible to represent movement of action in a certain predetermined range, e.g. integrally forming character's both hands or both legs on each of two indicator hands 103,; 104, that cannot be represented by rotation alone in one direction, and to restrict the indicator hands 103, 104 from abnormally moving.

Furthermore, where figures of both hands are integrally formed on the indicator hands 103, 104, both hands may be reciprocally moved in a rattling fashion in a predetermined range of movement or the indicator hands 103, 104 may be set variously in attaching angle, thereby making it possible to represent such motion that the character shows largely waving its hand or clapping its hands and to restrict the indicator hands 103, 104 from abnormally moving.

Furthermore, by arranging the indicator hands 103, 104 between the time hands (minute hand 101, hour hand 102) and the dial 107, these can be provided with a sense of identity with the design on the dial 107.

Also, because the indicator hands 103, 104 can be moved without relation to the time hands 101, 102, indicator hands 103, 104 with greatest possible moment can be employed in a range of causing no trouble for hand movement. Thus, the freedom in design increases and a variety of indication are made feasible.

Meanwhile, without providing a rotation detecting device for the motor 200, if a next period drive pulse is applied to the motor 200, normal operation can be restored automatically.

Incidentally, in each of the above concrete examples, although the motor used is a stepping motor 200 for timepieces structured by the coil 203, the stator 204 and the rotor magnet 205, a motor of another structure may be used in the form of usage that the indicator hands are changed only in rotation range by the restricting means to realize a variety of indications.

Also, in each of the above concrete examples, although the indicator hands 103, 104 were made to rotate at the same speed, they may be rotated at speeds different from each other.

Furthermore, in each of the above concrete examples, although the indicator hands 103, 104 were the same in rotation range, different ranges may be given.

Furthermore, in each of the above concrete examples, the time hands were structured by the minute hand 101 and the hour hands 102, a second hand may be added thereto.

Also, although the restricting means was structured by the convex parts 225 integrally formed on the wheel 209 and the restricting member 226 attached on the support plate 202, the restricting means can adopt various structure adjustable in restricting range of the indicator hands 103, 104, by, for example, attaching the restricting member 226 on the main plate 201 or integrally forming convex portions 225 on other wheels 210, 211, etc.

Industrial Applicability

As described above, the electronic timepiece with indicator hands according to the present invention is applicable to various electronic timepieces ranging from electronic wristwatches to wall-type electronic timepieces and desktop electronic timepieces.

What is claimed is:

1. An electronic timepiece with indicator hands comprising: time hands (101, 102) for showing a time; first and second indicator hands (103, 104) provided separately from said time hands (101, 102); rotating means for reciprocally rotating said first and second indicator hands (103, 104) in directions opposite to each other within a predetermined range; and restricting means for restricting a movable range and capable of adjusting a restricting position of said first and second indicator hands (103, 104).

2. An electronic timepiece with indicator hands according to claim 1, wherein said rotating means reciprocally rotates said first and second indicator hands (103, 104) at the same speed.

3. An electronic timepiece with indicator hands according to claim 1, wherein said rotating means has a stepping motor for timepieces (200) to alternately cause forward rotation and reverse rotation by a predetermined amount, a train wheel for delivering rotation of said stepping motor (200) to said first and second indicator hands (103, 104).

4. An electronic timepiece with indicator hands according to claim 3, wherein said restricting means is structured by a first engaging means (226) having a convex part (308) rotatably attached with eccentricity in a predetermined position and a second engaging part (225) provided on a wheel (209) included in said train wheel, so that, when said indicator hands (103, 104) are going to rotate toward the outside of a restricted movable range, said first engaging part (226) and said second engaging part (225) engage to thereby restrict rotation of said first and second indicator hands (103, 104).

* * * * *